US007794133B1

(12) United States Patent
Kern et al.

(10) Patent No.: US 7,794,133 B1
(45) Date of Patent: Sep. 14, 2010

(54) DUST-REDUCING MIXING DEVICE AND PROCESS

(75) Inventors: Paul Martin Kern, Gilmer, TX (US); Michael Lane Gentsch, Gilmer, TX (US); Billy Roy Scott, Diana, TX (US); Jeanne McCoy Scott, legal representative, Diana, TX (US); Norvell Edwin Wisdom, Jr., Longview, TX (US)

(73) Assignee: Scott Environmental Services, Longview, TX (US)

( * ) Notice: Subject to any disclaimer, the term of this patent is extended or adjusted under 35 U.S.C. 154(b) by 227 days.

(21) Appl. No.: 11/834,190

(22) Filed: Aug. 6, 2007

Related U.S. Application Data

(60) Provisional application No. 60/853,527, filed on Aug. 4, 2006.

(51) Int. Cl.
*B28C 5/16* (2006.01)

(52) U.S. Cl. ..... 366/3; 366/10

(58) Field of Classification Search ..... 222/236–242; 366/3, 10, 129, 155.1, 155.2, 325.1, 348; 406/38–44, 52, 62, 164, 166, 197
See application file for complete search history.

(56) References Cited

U.S. PATENT DOCUMENTS 3,123,256 A * 3/1964 Smith et al. ..... 222/146.6
3,289,897 A * 12/1966 Ginsberg ..... 222/239
3,568,771 A * 3/1971 Vincent et al. ..... 166/250.15
3,779,519 A * 12/1973 Anderson et al. ..... 366/3
4,152,029 A * 5/1979 Cowpertwait ..... 406/38
4,334,370 A * 6/1982 Holzenberger ..... 37/195
4,616,426 A * 10/1986 Large ..... 34/589
5,205,646 A * 4/1993 Kyllonen et al. ..... 366/3
5,766,338 A * 6/1998 Weber ..... 106/705
6,706,108 B2 * 3/2004 Polston ..... 106/285
2003/0116887 A1 * 6/2003 Scott ..... 264/333
2005/0190642 A1 * 9/2005 Jagle et al. ..... 366/129
2006/0182627 A1 * 8/2006 Tibban ..... 415/206

* cited by examiner

*Primary Examiner*—David L Sorkin
*Assistant Examiner*—Andrew Janca
(74) *Attorney, Agent, or Firm*—John E. Drach

(57) ABSTRACT

Mixing devices and processes that make it possible to mix flowable finely divided solid particles with liquids (and/or slurries of solids in liquids) contained in an open top container outdoors under windy conditions, with reduced or eliminated dusting from entrainment of the flowable finely divided solids by the wind, utilize a mixing device with a dust-tight housing open at its bottom and partially immersed below the surface of the liquid, an inlet port on the housing for the finely divided solids, an outlet port on the housing for escape of air displaced by liquids flowing through an opening into the immersed portion of the housing, and, inside the housing, a driven impeller that causes the actual mixing.

10 Claims, 1 Drawing Sheet

DUST-REDUCING MIXING DEVICE AND PROCESS

CROSS-REFERENCE TO RELATED APPLICATIONS

This application claims the benefit of provisional application Ser. No. 60/835,527, filed Aug. 4, 2006.

STATEMENT REGARDING FEDERALLY SPONSORED RESEARCH OR DEVELOPMENT

Not Applicable.

BACKGROUND OF THE INVENTION

It is often practically important to mix a finely divided dry solid material into a liquid and/or a slurry of solids in liquid, the phrase "liquid and/or a slurry of solids in liquid" and its optionally plural form "liquid(s) and/or at least one slurry of solids in liquid(s)" both being sometimes abbreviated hereinafter as "LSSL." When such mixing must be done while a gas such as air is moving laterally with respect to upper surface of the LSSL, as when working outdoors with natural winds blowing, some of the finely divided solid can be entrained by the moving gas, thereby preventing it from reaching the surface of the LSSL into which it is intended to be mixed and instead depositing it eventually as an unwanted dust in some other place. This phenomenon is called "dusting" in this specification.

Many attempts to avoid this problem have been described in prior art, but none has been found to be fully satisfactory for both effectiveness of dust reduction and economy of operation in every situation. In particular, objectionable dusting has been observed on some windy days when using earth moving machinery such as bulldozers and hydraulic excavators (hydraulic excavators being more commonly called "track hoes" or "trackhoes") to mix finely divided pozzolanic solids, and optionally other finely divided solids, into the slurries found in large oilfield pits containing previously used drilling mud and cuttings, as described in detail in U.S. patent application Ser. No. 10/037,630, filed Jan. 3, 2002, the entirety of the specification of which, except for any part thereof that may be inconsistent with any explicit statement herein, is hereby incorporated into this specification by reference.

Accordingly, a general object of this invention is to provide a mixer and mixing process that is less prone to unwanted dusting when mixing a finely divided solid material into a LSSL under conditions when there is lateral motion of a gas above the surface of the LSSL into which the finely divided solid is desired to be mixed. More particularly, a mixer and mixing process less dusting-prone than using earth moving equipment is provided for mixing finely divided pozzolanic and/or solids that reduce the plasticity index, i.e., the numerical difference between the plastic limit and the liquid limit, of the LSSL into slurries contained in oilfield pits in which used drilling mud and cuttings have been stored. (Materials that reduce the plasticity index of the LSSL when mixed with the LSSL are hereinafter usually denoted briefly as "plasticity-reducing materials." Most pozzolanic materials are also plasticity-reducing materials for slurries of most soils and/or drilling cuttings in liquids.) Most preferably the mixer and mixing process provided are capable of adequately mixing a finely divided pozzolanic and/or plasticity-reducing solid material with the contents of a large pit at least as rapidly as the use of earth moving machinery and at no greater overall cost.

BRIEF SUMMARY OF THE INVENTION

A process according to the invention for mixing a specified volume of flowable finely divided solids with a body of LSSL contained in an open top container comprises, preferably consists essentially of, or more preferably consists of the following operations:

(I) at least partially immersing at a first specified location within said open top of said container, through the open top of said container for said LSSL, a mixing device comprising, preferably consisting essentially of, or more preferably consisting of:

(A) at least one housing having:

(1) at least one opening in its immersed portion, said at least one opening(s) being of sufficient size that said LSSL spontaneously flows, under the influence of the pressure of the atmosphere to which said container for said LSSL is open at its top, into the immersed portion of said housing so as to fill said housing to substantially the same height as said LSSL has in its container within a time interval that is not more than, with increasing preference in the order given, 1,000, 500, 300, 200, 100, 75, 50, 40, 30, 20, 15, 10, 8, 6, 5, 4, 3, 2, 1, 0.7, 0.5, 0.4, 0.3, 0.2, or 0.1 minutes thereby generating a contained volume of LSSL within said housing; (2) continuous walls in its unimmersed portion, said walls being sufficiently nearly continuously solid to prevent the movement of said finely divided solids through any part of the unimmersed portion of said housing except through specific inlet and outlet ports in said continuous walls;

(3) at least one inlet port for introducing said finely divided solids into said housing, said at least one inlet port(s) having sufficient size that a fraction of said specified volume of flowable finely divided solids that is at least, with increasing preference in the order given, 0.001, 0.002, 0.005, 0.010, 0.020, 0.035, 0.050, 0.075, 0.10, 0.20, 0.35, 0.50, 0.75, 1.0, 2.0, 3.0, 4.0, or 5.0 times said specified volume can flow through said at least one inlet port(s) in one hour; and (4) at least one outlet vent port to allow escape of air pressure without escape of said finely divided solids;

(B) at least one impeller, propeller, and/or auger, all of the terms "impeller," "propeller" and "auger" being intended to be understood in the single term "impeller" as used hereinafter below, that is capable when driven of causing a downward flow in the gas space above the surface of said LSSL within said housing and is mounted within said housing;

(C) means for driving said at least LSSL one impeller so that it causes a downward flow in at least part of the gas space above the surface of said LSSL within said housing and in at least one part of the contained volume of LSSL present within the housing; and (D) means for causing at least a portion of said flowable finely divided solids to flow through said at least one inlet port without flowing into the surrounding atmosphere at a rate that is at least, with increasing preference in the order given, 0.001, 0.002, 0.005, 0.010, 0.020, 0.035, 0.050, 0.075, 0.10, 0.20, 0.35, 0.50, 0.75, 1.0, 2.0, 3.0, 4.0, or 5.0 times said specified volume per hour;

(II) after said housing is at least partially immersed in said LSSL as recited in operation (I) and, optionally and preferably, after the level of said LSSL inside said housing has come to equilibrium with the level of said LSSL in any other part of said container, driving said impeller and causing a first selected fraction of said specified volume of finely divided solids to flow into said housing through said at least one inlet port(s) until said first selected fraction of said specified volume of said flowable finely divided solids has been delivered into said housing and mixed with the LSSL within said housing; and (III) after completion of operations (I) and (II) as recited above, causing the mixed finely divided solids and LSSL contained within the housing to be discharged into said body of LSSL within said container; and, unless said selected fraction of said specified volume of finely divided solids in part (II) above is 1.0 or greater, (IV-I) at least partially immersing at a second specified location within said open top of said container, through the open top of said container for said LSSL, said mixing device as recited in part (I);

(IV-II) after said housing is at least partially immersed in said LSSL as recited in operation (IV-I) and, optionally and preferably, the level of said LSSL inside said housing has come to equilibrium with the level of LSSL in any other part of said container, driving said impeller and causing a second selected fraction of said specified volume of finely divided solids to flow into said housing through said at least one inlet port(s) until said second selected fraction of said specified volume of said flowable finely divided solids has been delivered into said housing and mixed with the LSSL within said housing; and (IV-III) after completion of operations (IV-I) and (IV-II) as recited above, withdrawing said housing from partial immersion in said body of LSSL, causing the mixed finely divided solids and LSSL contained within the housing to be discharged into said body of LSSL within said container; and, unless said selected fraction of said specified volume of finely divided solids in part (IV-II) when added to all previously such specified volumes is 1.0 or greater;

(V) continuing in like manner with as many repetitions of operation (IV) as are required for the cumulated total of all specified volumes from that in part (II) above to the last repetition of operation (IV) until said cumulated total of the successive selected fraction from operation (II) through the selected fraction of the last repetition of operation (IV) is 1.0 or greater.

A mixing device according to the invention comprises, preferably consists essentially of, or more preferably consists of, the following elements:

(A) at least one housing having:

(1) walls that are sufficiently nearly continuously solid to prevent the movement through said walls of solid particles having a minimum diameter that is at least, with increasing preference in the order given, 1,000, 700, 500, 300, 200, 100, 70, 50, 30, 20, 10, 7, 5, 3, 2, or 1 micrometers, except for passage of said solid articles through specific openings and inlet and outlet ports in said continuous walls;

(2) at least one opening in said continuous wall, each such opening being spaced on the walls with respect to any other such opening in such manner that the housing can be at least partially immersed in a liquid so that the liquid is free to flow through each opening while a part of the walls remains unimmersed, said at least one opening having an area at least as great as the cross-sectional area of an open right circular cylinder having a diameter of at least, with increasing preference in the order given, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 2.0, 2.5, or 3.0 meters;

(3) at least one inlet port suitable for introducing finely divided solids into said housing without allowing escape of the finely divided solids into the surrounding atmosphere and at least one outlet vent port, distinct from said inlet port, to allow escape of air pressure from the housing without escape of said finely divided solids, all of said inlet and outlet ports being spaced on the walls with respect to the openings recited in part (2) above and with respect to each other so that the housing can be at least partially immersed in a liquid with all of the openings recited in part (2) under the surface of the liquid and all inlet and vent ports remaining unimmersed, thereby generating a contained volume of said liquid within the housing;

(B) at least one impeller within said at least one housing, said impeller being capable when driven of causing a downward flow in at least part of space within said housing and, when said housing is at least partially immersed as recited in part (A)(3) above, is also capable when driven of causing a downward flow in at least part of the contained volume of the liquid;

(C) means for driving said at least one impeller so that it causes a downward flow as recited in part (B) next above; and (D) means for causing at least a portion of said flowable finely divided solids to flow through said at least one inlet port without flowing into the surrounding atmosphere.

BRIEF DESCRIPTION OF THE SEVERAL VIEWS OF THE DRAWING

The sole drawing FIGURE.

DETAILED DESCRIPTION OF THE INVENTION

Figure 1:
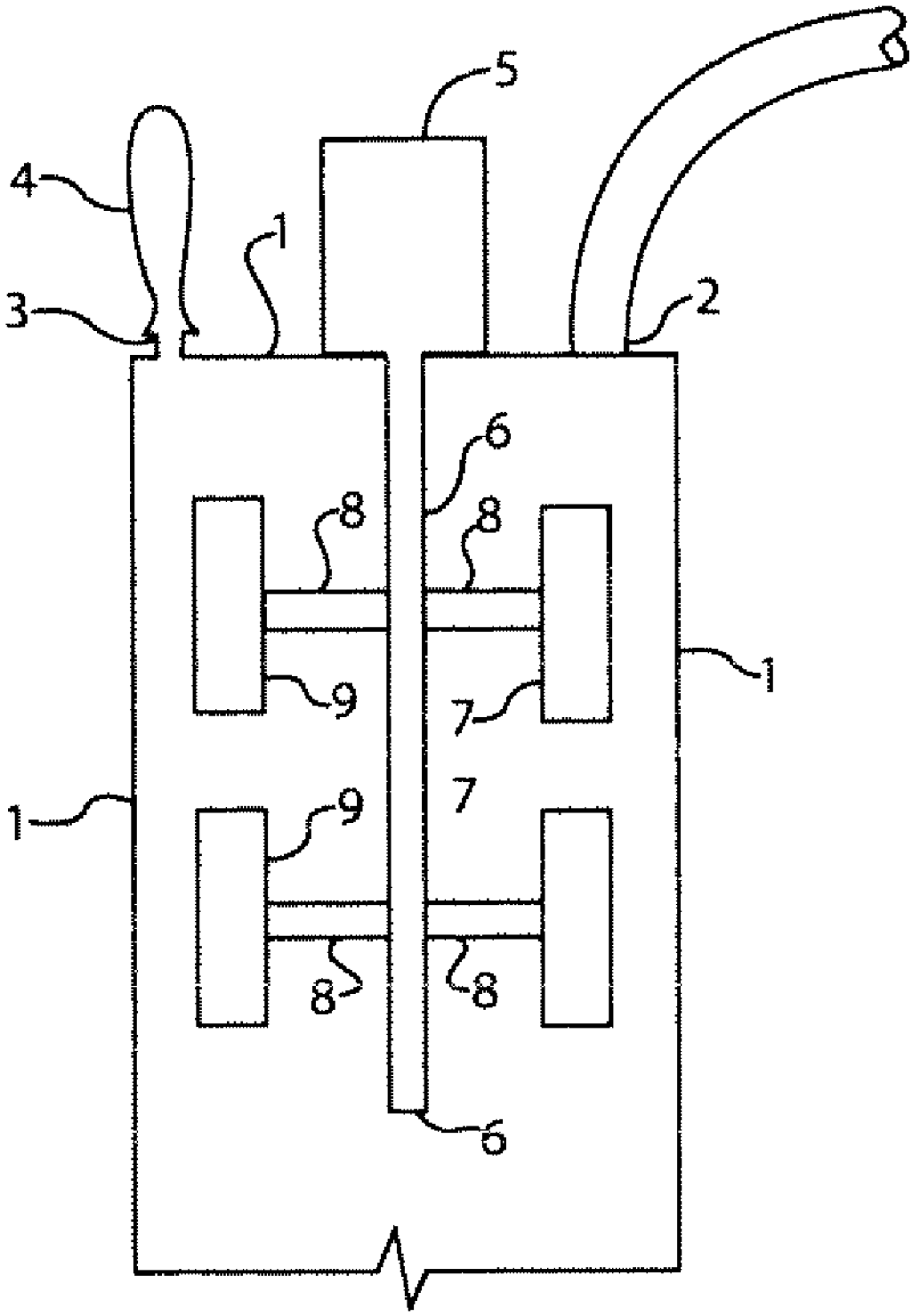
FIG. 1, is a partially schematic cross-section of a suitable embodiment of a mixer according to the invention. The mixer housing 1 is in the form of a right circular cylinder. The bottom end of the housing is entirely open except for conventional cross-bracing supports not shown. The lateral surface and top of the housing are continuous and dust-tight walls. The top wall is open in the interior of inlet port 2 and outlet port 3, the latter of which is terminated by a finely woven cloth dust filter 4. The inlet port is connected by a continuous walled connector to conventional means not shown for the introduction of flowable finely divided solids from a source not shown. The impeller of the mixer comprises: a central driving shaft 6 coupled to a low speed high torque hydraulic motor 5 which, except for a coupling portion that drives the central shaft, is outside the housing and is mounted on the top surface of the housing with a seal against escape of dust; upper and lower opposed pairs of arcuate impeller blades 7; and conventional connectors 8 which attach the blades to the central shaft. The lower pair of blades is shown in the drawing for convenience as approximately parallel to the upper pair of blades, and the blades are shown as if they were flat, but as discussed further below, these features are not preferred for actual use.

Preferably, the housing of said mixing device is sufficiently large that the housing can be immersed to the bottom of the open top container while still maintaining the outlet vent port(s) and inlet port(s) unimmersed. Independently, for use when mixing flowable divided solids with the slurried contents of a large pit, the total area of the hole(s) in the immersed portion of the housing is at least as great as the cross-sectional area of an open right circular cylinder having a diameter of at least, with increasing preference in the order given, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 2.0, 2.5, or 3.0 meters.

Whenever the volume of LSSL confined within the housing of said mixing device is substantially less than volume of the entire body of LSSL with which the entire specified volume of flowable finely divided particulate solids is eventually to be mixed in a process according to the invention, each of the second and other partial immersions of the housing of said mixing device through the open top of said container for said LSSL preferably is in a different location within the open top of said container from any previous location of immersion. This preference is particularly strong when, as is usually true when mixing pozzolanic and/or plasticity-reducing fine particulate solids with the contents of oil field pits, the process of mixing causes the volume of LSSL within the housing of the mixing device to substantially increase its apparent viscosity at low shear stresses. When such increases of apparent viscosity at low shear stresses occurs, the mixture discharged from the housing each time the housing is lifted from partial immersion in said body of LSSL does not usually visually noticeably mix spontaneously with any part of the LSSL originally present in the container that has not been mixed with pozzolanic and/or plasticity-reducing solids within a time that is not more than, with increasing preference in the order given, 60, 50, 40, 30, 20, 10, 7, 5, 4, 3, 2, 1, 0.7, 0.5, 0.4, 0.3, 0.2, or 0.1 minutes.

The shape of the housing of the mixing device used in a process according to the invention is not usually at all critical, unless the shape of the housing interacts with the characteristics of the impeller to affect substantially the uniformity of the mixture achieved or to reduce the speed of the mixing obtained within the housing before the housing is lifted after completion of mixing within one location of the housing. However, when it is desired as is usual to achieve substantial uniformity of mixing throughout the entire body of LSSL to be mixed, even though many repetitions of at least partial immersion of the housing in different parts of open surface of the container for the LSSL to be mixed are required, and especially when the mixture discharged from the housing each time the housing is lifted from at least partial immersion in said body of LSSL does not usually visually noticeably mix spontaneously with any part of the LSSL originally present in the container that has not been mixed with pozzolanic and/or plasticity-reducing solids within a time as specified in the preceding paragraph, it is more convenient and therefore preferred for the housing to have a cross-sectional shape, such as an equilateral triangle, square, or regular hexagon, that can completely fill a finite two-dimensional area when translated, optionally with rotation, from its first location to another location having one and only one common edge with the first location, and continuing such translations, each of which has one and only one common edge with the last previous location, until the area is filled.

On the other hand, if better, i.e., more nearly homogeneous and/or more rapid mixing is obtained by using a non-space-filling cross-sectional shape without overlap, such as a circle, such a use is within the contemplation of the invention. If a housing with a shape that does not fill areas without overlap is used and it is observed, after the completion of a process according to the invention as detailed above when the entire specified volume of finely divided solids to be mixed with the entire body of LSSL, that parts of the original LSSL within the container that have not been within the housing during any of the repetitions of at least partial immersions of the housing are visually obviously distinct from those parts of the original LSSL that have been within the housing during at least one of its immersions, the mixing can readily be improved by adding to the basic process as described above additional at least partial immersion(s) of the housing and driving of the impeller, without adding any further solids, but otherwise as described above, when the additional immersions cause any visually apparently less well mixed portion of the original body of LSSL between portion(s) previously brought within the housing of the mixing device to be brought for the first time within the housing of the mixing device. In such added operations, the number of repetitions of partial immersion of the housing and the timing of the driving of the impeller during each immersion can be determined by the time required to achieve apparent visual uniformity throughout the entire body of LSSL. It is also possible that, in some instances, some visually apparent lack of uniformity of the mixture can be tolerated without jeopardizing the intended utility of the mixture formed.

At least for economy, causing the mixed finely divided solids and LSSL contained within the housing to be discharged into said body of LSSL within said container as recited in operation (III) above normally is preferably accomplished by withdrawing said housing from partial immersion in said body of LSSL and allowing the contents within the housing to flow into the body of LSSL under the influence of earth's gravity. When this method of discharging is used, a mixing device according to the invention preferably additionally includes means for mechanically accomplishing such withdrawal of the mixing device and for moving it to a location within the open top of the container for the LSSL that is different from the location from which the mixing device was removed. An earth moving machine such as a hydraulic excavator is normally preferred as the means for this purpose, again primarily for economy, because other means of accomplishing such motion would normally require additional capital investment.

Many different variations of the means for causing the mixed finely divided solids and LSSL contained within the housing to be discharged into said body of LSSL within said container are within the scope of the invention. For example, an inlet for compressed air or other compressed gas may be provided on the unimmersed part of the housing of the mixing device, so that the mixed finely divided solids and LSSL contained within the housing can be discharged into said body of LSSL within said container without withdrawing the housing from at least partial immersion. This could be done quite simply, for example, by providing a T-joint to the inlet for finely divided solids and using the other arm of the T-joint to supply compressed gas when wanted. Appropriate use of valving, including if needed protection of the air outlet port from pressure, will be apparent to those of ordinary skill in the art. Alternatively, it is possible with some impeller designs to activate the impeller in a different direction or manner so that the impeller drives the mixed finely divided solids and LSSL contained within the housing out of the housing and into said body of LSSL within said container. Another alternative is to utilize an interior wall-scraping device, in addition to the impeller, in the interior of the housing. Such a scraping device may be mechanically driven, or, particularly if the mixed finely divided solids and LSSL contained within the housing have such high viscosity at low shear rates that the mixture does not flow out from the housing even when it is withdrawn from immersion, scraping with hand tools may be used. Many other variations and alternatives will be apparent to those skilled in the art.

The shape, size, and driving means of the impeller are not normally critical to the invention. However, at least for economy, it has been found usually preferable to utilize an impeller with a shaft that extends outward from the interior of the housing to the exterior of the housing through a bushing or similar device that is sealed against the passage of the finely divided solids to be mixed while permitting driving the impeller by rotary motion of some part of shaft outside the housing, said exterior rotary motion also imparting rotary motion to the part of the impeller within the housing. Any suitable means of imparting rotary motion to the impeller when rotation is used as the driving means may be used, including but not limited to hydraulic motors, electric motors, turbines driven by steam or any other fluid, internal combustion engines, or the like. For operation at oil field or other sites where electric power is not readily available, a hydraulic motor driven by the hydraulic take-off connection from an earth moving machine, such as a hydraulic excavator, generally used at the same site is usually most economical and preferred for that reason. Usually less economical but otherwise entirely suitable driving means, such as external rotating magnetic fields driving a permanent magnet on the portion of the impeller within the housing during use, may be used. In such an instance, no part of the impeller necessarily needs to extend through the housing, so that no seal between external and internal parts of the impeller is required.

The outlet port for escape of displaced air from the housing as LSSL enters the housing from the bottom is normally preferably provided with a filter or screen to assure against escape of particles of the size of the flowable finely divided solids. However, if the impeller is sufficiently effective in mixing the inflowing flowable finely divided solids into the LSSL contained within the housing, an outlet port open to the surrounding atmosphere may be acceptable and may then be preferred for economy.

For mixing of finely divided solids with slurries of solids in liquid, an impeller of the general type depicted in the drawing FIGURE is preferred. Such an impeller comprises a central rotating shaft as already described above, at least four blades, and means connecting the blades to the central rotating shaft so that all of the blades rotate at the same rotational speed as the central shaft and in locations such that, when the axis of rotation of the central shaft is perpendicular to the earth's surface beneath the shaft, at least two of the at least four blades are above the remaining blades, thereby separating the blades into upper and lower levels. With this type of impeller, the following specific preferences apply, each independently, and combinations of these preferences are more preferred, with preference increasing with the number of features combined, so that the greatest preference is to have the most preferred values for each of the characteristics specified below:

Each impeller blade has four corners, one corner being on each end of a lower and an upper edge of the blade, and when an impeller blade has four corners, a projection of the impeller blade onto a hypothetical plane that is defined by both corners of the top edge of the blade and the inner corner of the bottom edge of the blade has the shape of a quadrilateral with an upper side defined by a line in said plane through the projections onto said plane of the two corners of the upper edge of the blade and a lower side defined by a line in said plane passing through two points that are the projections onto said plane of the two corners of the lower edge of said blade; when all the previously recited characteristics in this paragraph are satisfied, it is still more preferable for the following characteristics also to be satisfied, each of them separately being independently preferred, combinations of the individual characteristics being preferred over satisfying a single condition, the preference increasing with the number of characteristics in the combination:

the upper and lower lines of the quadrilateral do not intersect when extended for a distance beyond the projections of their interior corner points that is at least, with increasing preference in the order given, 0.5, 1.0, 2.0, 3.0, 4.0, 6.0, or 10.0 times the distance between the projections of the two corners of the upper edge of the blade onto said plane;

all of the impeller blades have substantially the same size, the word "substantially" for this purpose being understood to mean that the length, on the plane to which the blade is projected as described above, of the projection of the lower edge on one blade is at least, with increasing preference in the order given, 0.75, 0.78, 0.82, 0.85, 0.88, 0.91, 0.94, or 0.97 times but independently not more than, with increasing preference in the order given, 1.3, 1.20, 1.17, 1.14, 1.11, 1.08, 1.05, or 1.02 times, the length on the plane to which it is correspondingly projected of the lower edge on any other blade; the length, on the plane to which the blade is projected as described above, of the projection of the upper edge on one blade is at least, with increasing preference in the order given, 0.75, 0.78, 0.82, 0.85, 0.88, 0.91, 0.94, or 0.97 times but independently not more than, with increasing preference in the order given, 1.3, 1.20, 1.17, 1.14, 1.11, 1.08, 1.05, or 1.02 times, the length on the plane to which it is correspondingly projected of the upper edge on any other blade; the length, on the plane to which the blade is projected as described above, of the projection of the edge on one blade between the two inner corners is at least, with increasing preference in the order given, 0.75, 0.78, 0.82, 0.85, 0.88, 0.91, 0.94, or 0.97 times but independently not more than, with increasing preference in the order given, 1.3, 1.20, 1.17, 1.14, 1.11, 1.08, 1.05, or 1.02 times, the length on the plane to which it is correspondingly projected of the edge between the inner corners on any other blade; and the length, on the plane to which the blade is projected as described above, of the projection of the edge on one blade between the two outer corners is at least, with increasing preference in the order given, 0.75, 0.78, 0.82, 0.85, 0.88, 0.91, 0.94, or 0.97 times but independently not more than, with increasing preference in the order given, 1.3, 1.20, 1.17, 1.14, 1.11, 1.08, 1.05, or 1.02 times, the length on the plane to which it is correspondingly projected of the edge between the outer corners on any other blade; and when there are exactly two blades on each of two levels, a hypothetical plane defined by the two upper edge corners of the blade and the inner corner of the lower edge of the same blade on one level intersect a corresponding second hypothetical plane defined by the two upper edge corners of a different blade and the inner corner of the lower edge of the same different blade on the other level at an interior angle that is at least, with increasing preference in the order given, 20, 40, 50, 60, 70, 75, 80, or 85 degrees of arc;

Each impeller blade is wider at its top than at its bottom; more particularly, the ratio of width of the blade at its bottom to the width of the same blade at its top preferably is at least, with increasing preference in the order given, 1.05, 1.10, 1.15, 1.20, 1.25, 1.30, 1.35, 1.40, 1.45, 1.50, or 1.55 and independently preferably is not more than, with increasing preference in the order given, 10, 7, 5, 3, 2.5, 2.0, 1.9, 1.8, 1.7, or 1.6;

The vertical length of each impeller blade preferably has a ratio to the width of the upper width of the same blade that is at least, with increasing preference in the order given, 1.5, 2.0, 2.5, 3.0, 3.5, 3.7, 3.9, 4.1, 4.2, 4.3, or 4.4 and independently preferably is not more than, with increasing preference in the order given, 20, 15, 12, 10, 8, 7.0, 6.0, 5.5, 5.3, 5.1, 4.9, or 4.7;

The distance from the outer corner of the bottom edge of each blade to the inside lateral surface of the housing has a ratio to the width of the bottom part of the blade that is at least, with increasing preference in the order given, 0.1, 0.3, 0.5, 0.60, 0.70, 0.75, 0.80, or 0.83 and independently preferably is not more than, with increasing preference in the order given, 10, 8, 7.0, 6.0, 5.0, 4.0, 3.0, 2.0, 1.8, 1.60, 1.50, 1.40, 1.35, 1.30, 1.25, 1.20, 1.15, 1.10, or 1.05;

The distance from the inner corner of the bottom edge of the blade to the nearest point on the outer surface of the driving shaft has a ratio to the width of the lower edge of each blade that is at least, with increasing preference in the order given, 0.5, 0.7, 0.9, 1.1, 1.3, 1.5, 1.55, 1.65, 1.70, 1.75, 1.80, 1.85, 1.90, or 1.95 and independently preferably is not more than, with increasing preference in the order given, 10, 8, 7.0, 6.0, 5.5, 5.0, 4.5, 4.0, 3.5, 3.0, 2.5, 2.3, or 2.1;

The vertical distance from the lower edge of an upper blade to the top edge of a lower has a ratio to the width of the lower edge of an upper blade that is at least, with increasing preference in the order given, 0.2, 0.4, 0.6, 0.70, 0.75, 0.80, 0.85, or 0.90 and independently preferably is not more than, with increasing preference in the order given, 5, 3.0, 2.5, 2.0, 1.5, or 1.0;

Each blade is arcuate in a circular arc with a radius of curvature that is at least, with increasing preference in the order given, 1.0, 1.5, 2.0, 2.5, 3.0, 3.20, 3.30, 3.40, 3.50, or 3.60 meters and independently preferably is not more than, with increasing preference in the order given, 20, 15, 10, 9.0, 8.0, 7.0, 6.0, 5.0, 4.0, or 3.8 meters; and independently the arc shape of each blade is the same as at least that of any blade with which it is paired on the same level, so that separated blades can nest within each other in the same manner as spoons of the same size from the same set of conventional tableware;

When the blades are arcuate, they are arranged so that all of their concave faces lead all of their convex faces during rotation in one direction around the central shaft, and the blades is rotated in said direction during mixing;

There are at least two blades on each level, and the total number of blades on each level is distributed at equal angular intervals around the central shaft.

For mixing of finely divided solids with slurries of solids in liquid with a rotating impeller of the type described last above, during use the impeller preferably has a rotational speed that is at least, with increasing preference in the order given, 50, 100, 150, 200, 250, 300, 325, 350, or 375 revolutions per minute ("rpm") and independently preferably is not more than, with increasing preference in the order given, 3,000, 2,000, 1,500, 1,000, 800, 700, 650, 600, 500, 475, 450, or 425 rpm.

The above-described preferences for the characteristics of the impeller are connected with obtaining the independently preferred mixing action achieved when the impeller is driven after being at least partially submerged below the level of the LSSL within the housing. This preferred mixing action includes strong subduction around the impeller shaft, so that finely divided solids that fall onto the surface of the LSSL are quickly drawn into the LSSL, and rising motion within the LSSL near the walls of the housing, so that material from near the bottom of the LSSL will be drawn upward along the housing walls and then fall under the influence of earth's gravity from the top of this upward flow down and inward into a vortex created by impeller motion near the central shaft.

Specific Example

A mixer as described in the drawing FIGURE, except for having the lower set of blades approximately perpendicular to the upper set of blades, is used. The housing has an inside diameter of about one and one-half meters and is about two and one-half meters high. Each of the four blades is about 15 centimeters (hereinafter usually abbreviated as "cm") wide at its top, about 23 cm wide at its bottom, and about 67 cm long from top to bottom. The inlet and outlet ports are left open for this simple example.

The hydraulic motor has the following characteristics: operating pressure, 2900 pounds per square inch maximum; output capacity, 53 gallons per minute maximum; displacement, 30.38 cubic inches; and torque, 12,950 inch-pounds maximum.

With this mixer's impeller turning at about 400 rpm, a fine sandy soil is added to and mixed with a slurry of the same soil in water that covers the lower set of impeller blades and approximately half covers the upper set of impeller blades, without losing sand to the surrounding air.

While examples of the invention have been described above, no limitation of the invention is intended thereby except for any limitations present in the appended claims.

The invention claimed is:

1. A process for mixing a specified volume of flowable finely divided solids with a body of LSSL contained in an open top container, said process comprising:

(I) at least partially immersing at a first specified location within said open top of said container, through the open top of said container for said LSSL, a mixing device comprising:

(A) at least one housing having:

(1) at least one opening in its immersed portion, said at least one opening(s) being of sufficient size that said LSSL spontaneously flows, under the influence of the pressure of the atmosphere to which said container for said LSSL is open at its top, into the immersed portion of said housing so as to fill said housing to a level in equilibrium with the level said LSSL outside the housing has in its container thereby forming a gas space within said housing within a time interval that is not more than 1000 minutes, thereby generating a contained volume of LSSL with the housing;

(2) continuous walls in its unimmersed portion, said walls being sufficiently nearly continuously solid to prevent the movement of said finely divided solids through any part of the unimmersed portion of said housing except through specific inlet and outlet ports in said continuous walls;

(3) at least one inlet port for introducing said finely divided solids into said housing, said at least one inlet port(s) having sufficient size that a fraction of said specified volume of flowable finely divided solids that is at least 0.001 times said specified volume can flow through said at least one inlet port(s) in one hour; and (4) at least one outlet vent port to allow escape of air pressure without escape of said finely divided solids;

(B) at least one impeller that is capable when driven of causing a downward flow in the gas space above the surface of said LSSL within said housing and is mounted within said housing;

(C) means for driving said at least one impeller so that it causes a downward flow in at least part of the gas space above the surface of said LSSL within said housing and in at least one part of said LSSL present within the housing; and (D) means for causing at least a portion of said flowable finely divided solids to flow through said at least one inlet port without flowing into the surrounding atmosphere at a rate that is at least 0.001 times said specified volume per hour;

(II) after said housing is at least partially immersed in said LSSL as recited in operation (I), driving said impeller and causing a first selected fraction of said specified volume of finely divided solids to flow into said housing through said at least one inlet port(s) until said first selected fraction of said specified volume of said flowable finely divided solids has been delivered into said housing and mixed with the LSSL within said housing, thereby generating mixed finely divided solids and LSSL within the housing; and (III) after completion of operations (I) and (II) as recited above, causing the mixed finely divided solids and LSSL contained within the housing to be discharged into said body of LSSL within said container; and, unless said selected fraction of said specified volume of finely divided solids in part (II) above is 1.0 or greater, (IV-I) at least partially immersing at a second specified location within said open top of said container, through the open top of said container for said LSSL, said mixing device as recited in part (I);

(IV-II) after said housing is at least partially immersed in said LSSL as recited in operation (IV-I), driving said impeller and causing a second selected fraction of said specified volume of finely divided solids to flow into said housing through said at least one inlet port(s) until said second selected fraction of said specified volume of said flowable finely divided solids has been delivered into said housing and mixed with the LSSL within said housing; and (IV-III) after completion of operations (IV-I) and (IV-II) as recited above, causing the mixed finely divided solids and LSSL contained within the housing to be discharged into said body of LSSL within said container; and, unless said selected fraction of said specified volume of finely divided solids in part (IV-II) when added to all previously such specified volumes is at least 1.0;

(V) continuing in like manner with as many repetitions of operation (IV) as are required for a cumulated total of all the successive selected fractions from operation (II) through the last repetition of operation (IV) to have a value of at least 1.0.

2. A process according to claim 1, wherein said LSSL is a slurry of solids in liquid.

3. A process according to claim 2, wherein said flowable finely divided solids comprise at least one of the group consisting of pozzolanic materials and plasticity-reducing materials.

4. A process according to claim 3, wherein said selected fraction utilized in operation (II) is less than 1.0, so that operation (IV-II) is required to complete the process, and immersion at said second specified location during operation (IV-I) is at a location within the open top container that is different from the first specified location.

5. A process according to claim 4, wherein a sum of the selected fractions utilized in operations (II) and (IV-II) is less than 1.0, so that operation (V) is required to complete the process, and immersion of the housing in each repetition of operation (IV) is at a specified location different from the first specified location, the second specified location, and any other preceding specified location in the process.

6. A process according to claim 5, wherein the mixed finely divided solids and LSSL contained within the housing are discharged into said body of LSSL within said container by withdrawing said housing from partial immersion in said body of LSSL and allowing the contents within the housing to flow into the body of LSSL under the influence of Earth's gravity.

7. A process according to claim 1, wherein said flowable finely divided solids comprise at least one of the group consisting of pozzolanic materials and plasticity-reducing materials.

8. A process according to claim 1, wherein said selected fraction utilized in operation (II) is less than 1.0, so that operation (IV-II) is required to complete the process, and immersion at said second specified location during operation (IV-I) is at a location within the open top container that is different from the first specified location.

9. A process according to claim 8, wherein a sum of the selected fractions utilized in operations (II) and (IV-II) is less than 1.0, so that operation (V) is required to complete the process, and immersion of the housing in each repetition of operation (IV) is at a specified location different from the first specified location, the second specified location, and any other preceding specified location in the process.

10. A process according to claim 1, wherein the mixed finely divided solids and LSSL contained within the housing are discharged into said body of LSSL within said container by withdrawing said housing from partial immersion in said body of LSSL and allowing the contents within the housing to flow into the body of LSSL under the influence of Earth's gravity.

* * * * *

UNITED STATES PATENT AND TRADEMARK OFFICE

CERTIFICATE OF CORRECTION

PATENT NO. : 7,794,133 B1
APPLICATION NO. : 11/834190
DATED : September 14, 2010
INVENTOR(S) : Paul Martin Kern et al.

It is certified that error appears in the above-identified patent and that said Letters Patent is hereby corrected as shown below:

On the Title Page

(75) Inventors:
Michael Lane Gentsch, "Gilmer," TX (US)
should read
Michael Lane Gentsch, -- Longview, -- TX (US)

(60) Provisional application No. 60/"853," 527, filed on Aug. 4, 2006
should read
Provisional application No. 60/ -- 835, -- 527, filed on Aug. 4, 2006

Signed and Sealed this
Eleventh Day of January, 2011

David J. Kappos

David J. Kappos
*Director of the United States Patent and Trademark Office*